United States Patent [19]

Mellinger

[11] 4,300,607

[45] Nov. 17, 1981

[54] VARIABLE LENGTH TOOL HANDLE

[76] Inventor: Ralph D. Mellinger, 1305 Hillsway Ct., Baltimore, Md. 21234

[21] Appl. No.: 128,255

[22] Filed: Mar. 7, 1980

[51] Int. Cl.[3] ..... B25G 1/08

[52] U.S. Cl. ..... 145/62; 145/61 J

[58] Field of Search ..... 145/61 J, 62, 63, 61 E

[56] References Cited

U.S. PATENT DOCUMENTS

| | | | |
|---|---|---|---|
| 562,416 | 6/1896 | Powers et al. | 145/62 |
| 686,424 | 11/1901 | Smith | 145/62 |
| 1,250,328 | 12/1917 | Langford | 145/62 |
| 1,421,792 | 7/1922 | Linden | 145/62 |
| 1,541,078 | 6/1925 | Sudweeks | 145/62 |
| 1,955,419 | 4/1934 | Gerard | 145/62 |
| 2,022,775 | 12/1935 | Holland-Letz | 145/62 |
| 2,031,044 | 2/1936 | Jensen et al. | 145/50 R |
| 2,105,239 | 1/1938 | Bachtold | 145/62 |
| 2,717,442 | 9/1955 | Smith | 145/62 |

FOREIGN PATENT DOCUMENTS

| | | | |
|---|---|---|---|
| 403769 | 1/1934 | United Kingdom | 145/62 |

OTHER PUBLICATIONS

Prechtl, Technologische Encyklopaedie, vol. 9, Plate 326, 145–162, Stuttgart, 1846.

*Primary Examiner*—Stephen G. Kunin
*Assistant Examiner*—J. T. Zatarga
*Attorney, Agent, or Firm*—Brian David Voyce

[57] ABSTRACT

A segmented handle is characterized by an upper gripping member having an opening which partially extends therethrough. At least one lower gripping member is positioned adjacent the upper gripping member and has an opening extending therethrough to permit communication with the opening in the upper gripping member. An apparatus for releasably securing the gripping members in a fixed, coaxial relationship is positioned on adjacent portions of said members. Alternatively, the above apparatus may be disposed in the opening of the upper gripping member.

5 Claims, 6 Drawing Figures

VARIABLE LENGTH TOOL HANDLE

DESCRIPTION

1. Technical Field

The present invention relates to segmented handles of variable length. An upper and lower gripping member comprise the handle. A tool shaft engages either both of these members or only the upper member.

2. Background Art

Combination tools and extensible handles have taken many differing forms in the prior art. U.S. Pat. No. 291,840 to Jacobs discloses a detachable extension handle for tools. Detachable sections having interlocking parts enable one to engage the top of one shaft with a bottom portion of a second shaft. Each section is equipped with gripping members. Thus, the overall length of the tool and positional changes in the gripping members are dependent upon varying the length of the shaft. A means for varying the handle while maintaining a fixed-length shaft is not revealed. One must carry additional shafts to either extend or reduce the effective handle length.

A combination brace tool is set forth in U.S. Pat. No. 2,715,926 to Harris. A brace member possesses a chuck body connected to an offset cylindrical extension. A separate handle with a chuck body identical to the one in the brace member engages one end of the extension. The same bits may be used with either the handle alone or the combined brace tool. The handle, however, is a unitary member which is not extensible in any manner.

A segmented handle is also disclosed in U.S. Pat. No. 2,775,276 to Rossner. The handle comprises a main tool turning portion and a cap portion at the rear end of the handle. When the cap is engaged by one's hand, the tool may be turned while the cap remains stationary. Though segmented, the handle suggests no means or reason to permit the main portion to be detached from both the shaft and the cap. On the contrary, the disclosure always requires the two portions together to perform the rotating function.

Finally, a form of extensible handle is related in U.S. Pat. No. 3,752,202 to Condon. A hand fastener driving tool incorporates a handle defining a specially configured bore for receiving the head end of a bit. Essentially, a larger diameter handle is slipped over an existing one to magnify the torque. But, the shank of the bit does not directly cooperate with the larger handle. One cannot obtain a shorter handle along with a more exposed shaft. The overall length of the tool varies with the changes in the handle. In cramped working conditions, this can cripple the use of the tool.

DISCLOSURE OF INVENTION

In accordance with the present invention, a segmented handle is characterized by an upper gripping member having an opening which partially extends longitudinally therethrough. At least one lower gripping member is positioned adjacent the upper gripping member and has an opening extending therethrough to permit communication with the opening in the upper gripping member. A means for releasably securing the gripping members in a fixed, coaxial relationship is positioned on adjacent portions of said members.

A shaft is dimensioned and configured to be slidably received through the opening in the lower gripping member. A means is provided for preventing rotational slippage of the shaft in relation to the gripping members.

The instant invention also relates to a segmented handle having the above gripping members, shaft, and nonrotational means wherein a means is disposed in the opening of the upper gripping member for releasably retaining a shaft.

BEST MODE FOR CARRYING OUT THE INVENTION

Figure 1:
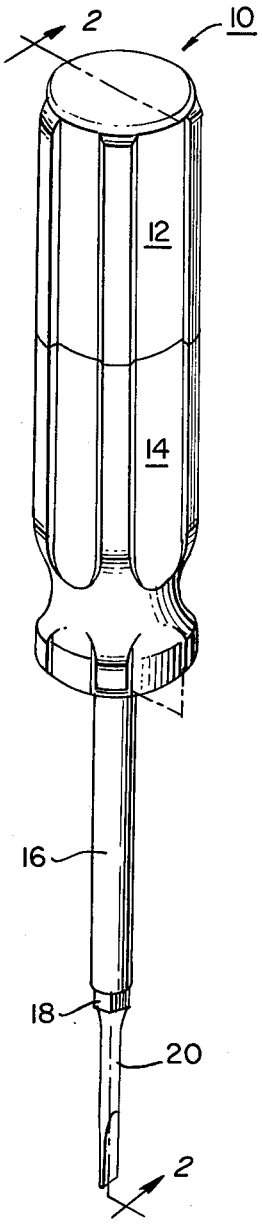
FIG. 1 is a perspective view of the presently claimed handle.

The instant segmented handle, as seen in FIG. 1, is characterized by at least one upper gripping member 12 and a lower gripping member 14. An interlocking, releasably securing means is disposed on these members whereby a tool shaft 16 may be employed with either the entire handle comprised of multiple members or only the upper gripping member. Thus, the effective length of the handle is variable.

Figure 2:
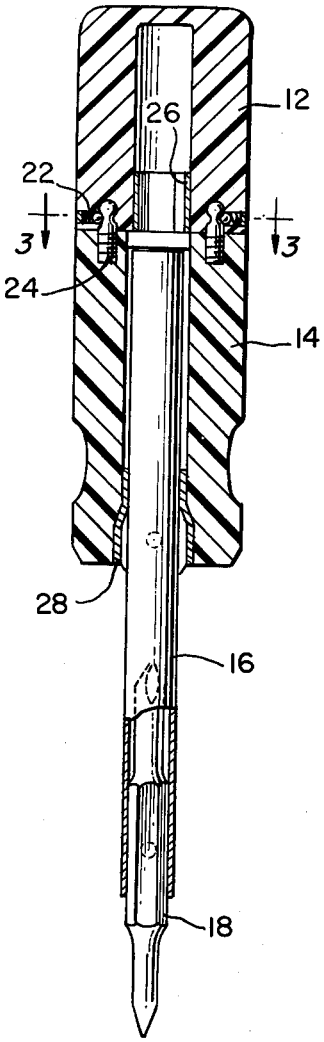
FIG. 2 is a lateral, sectional view of an embodiment of the present invention employing positional means on the adjacent gripping members.

A more detailed illustration of a preferred embodiment of the releasably securing means may be seen in FIG. 2. The upper gripping member 12 has detents 22 located in the bottom portion which is adjacent lower gripping member 14. Furthermore, these detents may contain spring-loaded balls of a conventional nature which engage pins 24. Preferably, the vertical pins secured and disposed in the lower gripping member 14 are dimensioned and configured with a groove for cooperative engagement with the horizontally tensioned balls. The net result is a retention of the upper gripping member to the lower gripping member under normal torque stress. A directed translational force, however, will release the separate members.

Shaft 16 is prevented from turning within the handle opening. A suitable means to prevent slippage are integral ribs 28. Both simple and economical, ribs have typically been employed in conventonal screwdrivers.

Figure 4:
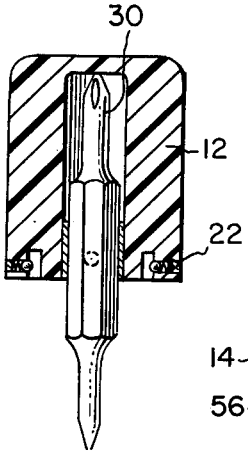
FIG. 4 is a shortened embodiment of the handle in FIG. 2 utilizing only the upper gripping member.

The ends of the shaft may be adapted for multiple uses. The illustrated shaft is dimensioned and configured to receive a hexagonally shaped chuck 18 on both the exposed lower end and the sheathed upper end. In turn, the chuck is equipped with bits at both ends. One could employ different size Phillips driver bits, for example. Another embodiment could incorporate different drivers, i.e., both a Phillips 30 and a regular 32 screwdriver end (FIG. 4). It should be noted that the receiving ends of the shaft can also be hexagonally shaped. Thus, the shaft alone can function as a nut driver. Again, a multiple usage is achieved if the ends are designed as different size nut drivers. One end may be $\frac{1}{4}$ inch, while the other is 5/16 inch.

Figure 5:
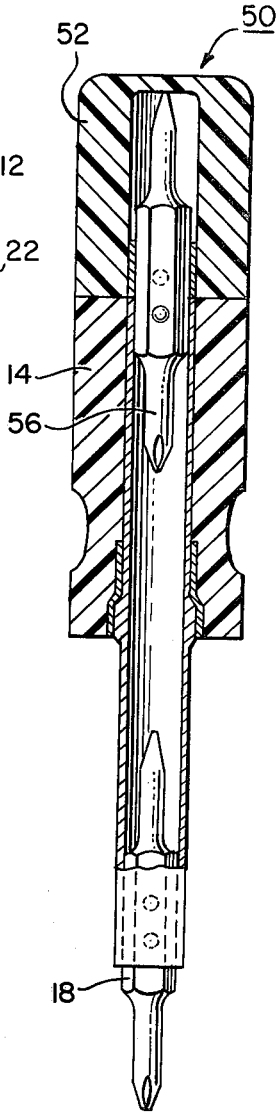
FIG. 5 is a transverse view of another embodiment of the present invention; and, FIG. 6 is a cross-sectional view of a shortened embodiment of the handle in FIG. 5 wherein only the upper gripping member is used.
Figure 3:
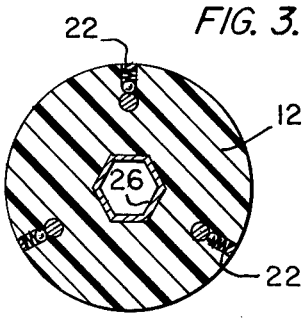
FIG. 3 is a cross-sectional view of the upper gripping member in FIG. 2.

Another equally suitable embodiment of the present invention is shown in FIG. 5. The same shaft design of FIG. 2 is found in this variation. The difference is found in the means for releasably securing the gripping members. The shaft, as well as a bit, forms part of this means. Specifically, a bit 56 having a hexagonally shaped chuck is inserted into and extends beyond the upper end of the shaft 16. Upper gripping member 52 comprises a hexagonally shaped opening 26 which engages the extended portion of the bit. A spring-loaded ball 54 in the chuck 18 may be used for the engagement. Alternatively, the ball, when positioned in the upper gripping member, could engage a grooved chuck (not illustrated).

The lower gripping member 14 is held in position by the ribs 28 and the chuck engagement. The former prevents downward slippage. Of course, the latter governs the upward displacement of the lower gripping member. In other words, said member is sandwiched between the above means. Removal of the lower member is easily accomplished by forcefully disengaging the upper chuck and upwardly slipping off the member.

A variation of embodiment 52 alters the engagement of the upper gripping member. Instead of the chuck, the shaft closely fits within the upper member. A tensioned ball means as previously described may be disposed in either of the above elements to releasably secure the handle. The stated configuration also sandwiches the lower member.

Figure 6:
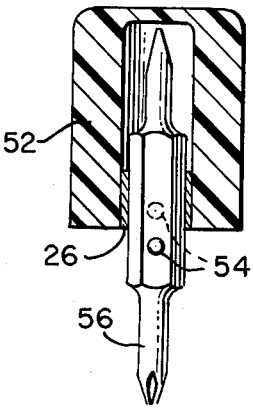

The shortened handle represented by the upper member possesses an additional function, as seen in FIGS. 4 and 6. The chuck alone is used without retaining the shaft. With two chucks available, another four combinations are formed when employing the single member. Significantly, the retention means disposed in the upper member do not protrude or otherwise interfere with the manual operation of the tool.

In summation, a most versatile tool is instantly disclosed. The segmented handle permits one to store six possible tool functions in one shaft. But, more importantly, the handle can also be either shortened or lengthened as desired without sacrificing the storage of the various functional components. Such versatility is extremely important in many field-oriented applications. When one is working in a relatively inaccessible environment, a mechanic would rather carry and look after one tool. He does not want to worry about either misplacing or even forgetting the location of one of many tools.

An excellent, practical application may be found in the repair of rooftop air conditioners. The loss of a tool represents a waste of the mechanic's time. In addition, one may find, upon inspection of the plant, that he does not possess the correct nut or screwdriver. With the present invention, the mechanic may, essentially, group sixteen tools instead of six into one combination tool. The use of the segmented handle minus the lower gripping member, but with the shaft and bits, represents an added set of five functions. The longer, combined handle may not permit access to a particular nut, although the shaft is long enough. Removal of the lower member enables usage.

The final four functions eliminate the shaft and involve only the upper gripping member and the chuck/-bits. These particular combinations are extremely useful when overall tool length is the prime consideration. The presently disclosed handle encompasses these situations.

Having discribed the invention with particular reference to the preferred form thereof, it will be obvious to those skilled in the art to which the invention pertains, after understanding the invention, that various changes and modifications may be made therein without departing from the spirit and the scope of the invention as defined by the claims appended hereto.

I claim:

1. A segmented handle of variable length which is characterized by:

(a) an upper gripping member having a opening which partially extends longitudinally therethrough whereby the opening is dimensioned and configured to accomodate a chuck and cooperate with releasable retention means disposed on the chuck;

(b) at least one lower gripping member (i) positioned adjacent to the upper gripping member, and (ii) having an opening extending longitudinally therethrough whereby a shaft may be inserted into the opening in the lower gripping member and communicate with the upper gripping member;

(c) a hollow shaft dimensioned and configured (i) for receiving a chuck at either end and cooperating with releasable retention means on the chuck, and (ii) to be received by the opening in the lower gripping member;

(d) a means for preventing rotational slippage of the hollow shaft in relation to the lower gripping member;

(e) at least one chuck dimensioned and configured to be received both within one end of the hollow shaft and the upper gripping member; and (f) a means disposed on the chuck for releasably retaining the chuck within the shaft and the upper gripping member;

thereby providing a secure connection between the combined gripping members and the shaft when the chuck is inserted into both the one end of the shaft surrounded by the lower gripping member and into the opening in the upper gripping member, and also permitting a secure connection between the chuck and the upper gripping member alone.

2. The segmented handle recited in claim 1 wherein the chuck is characterized by a polygonal configuration.

3. A segmented handle of variable length which is characterized by:

(a) an upper gripping member having an opening which partially extends longitudinally therethrough whereby the opening is dimensioned and configured to accomodate a chuck disposed in the upper end of a hollow shaft;

(b) at least one gripping member (i) positioned adjacent to the upper gripping member, and (ii) having an opening extending longitudinally therethrough whereby a shaft may be inserted into the opening in the lower gripping member and communicate with the upper gripping member;

(c) a means disposed on the adjacent portions of the gripping members for releasably securing said members in a fixed coaxial relationship;

(d) a hollow shaft dimensioned and configured (i) for receiving a chuck at either end and cooperating with a releasable retention means on the chuck, and (ii) to be received by the opening in the lower gripping member;

(e) a means for preventing rotational slippage of the hollow shaft in relation to the lower gripping member;

(f) at least one chuck dimensioned and configured to be received both within one end of the hollow shaft and the opening of the upper gripping member;

(g) a means disposed on the shaft for releasably retaining the shaft in relation to the lower gripping member; and (h) a means disposed on the chuck for releasably retaining the chuck within the shaft and the upper gripping member;

thereby providing a secure connection between the shaft and the combined gripping members when said members are disposed in the fixed coaxial relationship, and also permitting a secure connection between the chuck and the upper gripping member alone.

4. The segmented handle recited in claim 3 wherein the means disposed on the adjacent portions of the gripping members is characterized by a plurality of pins disposed on one member and an equal number of spring-biased ball detents disposed in the other member whereby each pin may be releasably secured in an appropriately positioned detent by the spring-biased ball.

5. The segmented handle recited in claims 3 or 4 wherein the means disposed on the shaft for releasably retaining the shaft is characterized by a spring-biased ball which releasably engages the opening in the lower gripping member.

* * * * *